US007492106B2

(12) United States Patent
Sengoku et al.

(10) Patent No.: US 7,492,106 B2
(45) Date of Patent: Feb. 17, 2009

(54) INVERTER CIRCUIT, BACKLIGHT ASSEMBLY, LIQUID CRYSTAL DISPLAY HAVING THE SAME, AND METHOD THEREOF

(75) Inventors: Osamu Sengoku, Tokyo (JP); Takashi Kinoshita, Tokyo (JP); Tatsuhisa Shimura, Tokyo (JP)

(73) Assignee: Samsung Electronics Co., Ltd. (KR)

( * ) Notice: Subject to any disclaimer, the term of this patent is extended or adjusted under 35 U.S.C. 154(b) by 140 days.

(21) Appl. No.: 11/520,913

(22) Filed: Sep. 14, 2006

(65) Prior Publication Data

US 2007/0108918 A1 May 17, 2007

(30) Foreign Application Priority Data

Nov. 17, 2005 (KR) ..... 10-2005-0109994

(51) Int. Cl.
*H05B 37/00* (2006.01)

(52) U.S. Cl. ..... 315/276; 315/278; 315/312; 345/102

(58) Field of Classification Search ..... 315/276–278, 315/274, 282, 312, 291, DIG. 2, 224, 119; 345/102, 87, 84, 55, 30; 349/70, 61, 56
See application file for complete search history.

(56) References Cited

U.S. PATENT DOCUMENTS 7,119,495 B2 * 10/2006 Jang ..... 315/291
7,294,971 B2 * 11/2007 Jin ..... 315/246
7,309,964 B2 * 12/2007 Wey et al. ..... 315/312
2004/0257003 A1 * 12/2004 Hsieh et al. ..... 315/312
2005/0253537 A1 * 11/2005 Jang et al. ..... 315/307
2006/0125424 A1 * 6/2006 Gray ..... 315/312
2006/0290453 A1 * 12/2006 Park et al. ..... 336/69

FOREIGN PATENT DOCUMENTS

| | | |
|---|---|---|
| JP | 2000-197368 | 7/2000 |
| JP | 2002-141186 | 5/2002 |
| JP | 2002-341775 | 11/2002 |
| JP | 2005-183099 | 7/2005 |

* cited by examiner

*Primary Examiner*—Douglas W. Owens
*Assistant Examiner*—Ephrem Alemu
(74) *Attorney, Agent, or Firm*—Cantor Colburn LLP

(57) ABSTRACT

A backlight assembly prevents abnormal discharge of a device using a high voltage to drive a discharge tube such as CCFL. An inverter circuit includes an inverter transformer supplying an AC high voltage to a plurality of discharge tubes, and a plurality of balance transformers. First terminals of primary coils of the balance transformers are connected to the discharge tubes, and second terminals of the primary coils are connected to a ground. Secondary coils of the balance transformers are connected in series to form a loop. A resistor has a first terminal connected to the loop and a second terminal connected to the ground. Accordingly, the backlight assembly may detect a high-voltage abnormal discharge such as a corona discharge, an arc discharge or the like.

23 Claims, 13 Drawing Sheets

INVERTER CIRCUIT, BACKLIGHT ASSEMBLY, LIQUID CRYSTAL DISPLAY HAVING THE SAME, AND METHOD THEREOF

This application relies claims priority to Korean Patent Application No. 2005-109994, filed on Nov. 17, 2005 and all the benefits accruing therefrom under 35 U.S.C. §119, and the contents of which in its entirety are herein incorporated by reference.

BACKGROUND OF THE INVENTION

1. Field of the Invention

The present invention relates to an inverter circuit, a backlight assembly, a liquid crystal display ("LCD") having the same, and a method thereof. More particularly, the present invention relates to an inverter circuit that can detect an abnormal discharge at a high voltage, a backlight assembly having the inverter circuit, an LCD having the inverter circuit, and a method of detecting the abnormal discharge.

2. Description of the Related Art

LCDs have been required to have a lightweight structure, slim profile, low driving voltage, and low power consumption. Because LCDs are not self-luminous, a separate light source is needed. A cold cathode fluorescent lamp ("CCFL") is widely used as the light source.

The CCFL is a fluorescent lamp that operates in the range of a normal glow discharge and is turned on/off by an AC high voltage.

Since the CCFL is not dependent on a preheating of filament, it has good vibration resistance compared with a hot cathode tube. Also, the CCFL can be made small in diameter and has a long lifetime.

Generally, an inverter circuit is used to generate the AC high voltage to turn on the CCFL. When an insulation failure occurs in an insulating material between a high voltage part and a ground due to the use of the AC high voltage, the CCFL is subject to high voltage discharge, such as a corona discharge, an arc discharge, etc. The high voltage discharge gradually carbonizes the insulating material, thereby causing a short circuit, a burning, and a smoking.

The insulation failure may be caused by bending or burring of electrodes, soldering crack, loss of insulating material, non-uniformity or deformation of the insulating material, and so on. Also, the insulation failure may be caused by degradation with time.

FIG. 1 is a circuit diagram of a conventional detector detecting an abnormal current caused by a high voltage discharge.

Referring to FIG. 1, a current detection resistor 200 is connected to a ground side of a secondary coil of an inverter transformer 900. The inverter transformer 900 boosts an AC voltage 94 and outputs AC high voltage 95 to the CCFLs 300. A differential circuit 45 having a condenser and a resistor detects a peak of a spike voltage occurring when an abnormal current caused by a high voltage discharge flows. A comparator 41 compares the detected peak voltage with a reference voltage 44. Through these operations, the abnormal current can be detected, and a control voltage 43 can be output from the voltage comparator 40.

Another related art will be described with reference to FIG. 2. FIG. 2 is a circuit diagram of a detector disclosed in Japanese Patent Laid-Open Publication No. 2002-341775. The detector of FIG. 2 detects a corona discharge that occurs in a transformer or a CCFL of a flat display device such as an LCD.

In the detector of FIG. 2, an inverter transformer is mounted on a printed board, and induction patterns are formed on a bottom surface of the inverter transformer and around a lamp. The detector detects the corona discharge using a voltage induced from the induction patterns.

The detector of FIG. 1 can detect the abnormal current caused by the high voltage discharge, but cannot detect it when the discharge occurs in a state that the high voltage part and the ground are in a high impedance state because the spike current is reduced.

Also, the detector of FIG. 2 can detect only the high voltage discharge around the inverter transformer and the lamp. That is, the detector cannot detect the high-voltage abnormal discharge that is caused when insulation failure occurs in the insulating material between another high voltage part and the ground.

BRIEF SUMMARY OF THE INVENTION

The present invention provides an inverter circuit capable of detecting high-voltage abnormal discharge, such as corona discharge and arc discharge, which is caused by various factors, such as when an insulation failure occurs in an insulating material between a high voltage part and a ground.

The present invention also provides a backlight assembly having the above inverter circuits, where the backlight assembly may include a plurality of discharge tubes (e.g., cold cathode fluorescent lamps "CCFL") used as a light source.

The present invention also provides an LCD having the above backlight assembly.

The present invention also provides a method of detecting the abnormal discharge within the backlight assembly.

In exemplary embodiments of the present invention, an inverter circuit includes an inverter transformer supplying an AC high voltage to a plurality of discharge tubes, a plurality of balance transformers, and a resistor. First terminals of primary coils of the balance transformers are connected to the discharge tubes and second terminals of the primary coils are connected to a ground. First terminals of the discharge tubes are connected to output terminals of the inverter transformer, and second terminals of the discharge tubes are connected to the first terminals of the primary coils of the balance transformers. Secondary coils of the balance transformers are connected in series to form a loop. A first terminal of the resistor is connected to the loop, and a second terminal of the resistor is connected to the ground. A voltage detection contact point is located on the loop where at least one secondary coil of the balance transformers is interposed between the voltage detection contact point and a point to which the first terminal of the resistor is connected.

In other exemplary embodiments of the present invention, an inverter circuit includes an inverter transformer supplying an AC high voltage to a plurality of discharge tubes, a plurality of balance transformers, and a resistor. The inverter transformers are disposed such that AC high voltages of secondary coils of the inverter transformers have opposite polarities to one another, and the discharge tubes include a first discharge tube and a second discharge tube. The first discharge tube, primary coils of the balance transformers, and second discharge tube are connected in series to the AC high voltages of the opposite polarities outputted from the secondary coils of the inverter transformers. The secondary coils of the balance transformers are connected in series to form a loop. A first terminal of the resistor is connected to the loop, and a second terminal of the resistor is connected to a ground. A voltage detection contact point is located on the loop where at least one secondary coil of the balance transformers is interposed between the voltage detection contact point and a point to which the first terminal of the resistor is connected.

In other exemplary embodiments of the present invention, a backlight assembly includes a plurality of discharge tubes, an inverter transformer supplying an AC high voltage to the plurality of discharge tubes, a plurality of balance transformers, and a resistor. First terminals of primary coils of the balance transformers are connected to the discharge tubes, and second terminals of the primary coils are connected to a ground. First terminals of the discharge tubes are connected to output terminals of the inverter transformer, and second terminals of the discharge tubes are connected to the first terminals of the primary coils of the balance transformers. Secondary coils of the balance transformers are connected in series to form a loop. A first terminal of the resistor is connected to the loop and a second terminal of the resistor is connected to the ground. A voltage detection contact point is located on the loop where at least one secondary coil of the balance transformers is interposed between the voltage detection contact point and a point to which the first terminal of the resistor is connected.

In other exemplary embodiments of the present invention, a backlight assembly includes a plurality of discharge tubes, an inverter transformer supplying an AC high voltage to the plurality of discharge tubes, a plurality of balance transformers, and a resistor. The inverter transformers are disposed such that AC high voltages of secondary coils of the inverter transformers have opposite polarities to one another. The discharge tubes include a first discharge tube and a second discharge tube. The first discharge tube, primary coils of the balance transformers and second discharge tube are connected in series to the AC high voltages of the opposite polarities outputted from the secondary coils of the inverter transformers. Secondary coils of the balance transformers are connected in series to form a loop. A first terminal of the resistor is connected to the loop, and a second terminal of the resistor is connected to a ground. A voltage detection contact point is located on the loop where at least one secondary coil of the balance transformers is interposed between the voltage detection contact point and a point to which the first terminal of the resistor is connected.

In other exemplary embodiments of the present invention, an LCD includes a liquid crystal panel displaying an image. The liquid crystal panel may include a plurality of gate lines, a plurality of data lines substantially perpendicular to the gate lines, a plurality of switching elements connected to the gate lines and the data lines, and liquid crystal elements connected to the switching elements and an inverter circuit. The LCD may also include a display unit having the liquid crystal panel, a data circuit and a gate circuit connected to the liquid crystal panel, a backlight assembly having a plurality of discharge tubes, a case receiving the backlight assembly, a top chassis protecting the liquid crystal panel, and at least one optical sheet disposed between the liquid crystal panel and the backlight assembly. The inverter circuit includes an inverter transformer supplying an AC high voltage to the plurality of discharge tubes, a plurality of balance transformers, and a resistor. First terminals of primary coils of the balance transformers are connected to the discharge tubes, and second terminals of the primary coils are connected to a ground. First terminals of the discharge tubes are connected to output terminals of the inverter transformer, and second terminals of the discharge tubes are connected to the first terminals of the primary coils of the balance transformers. Secondary coils of the balance transformers are connected in series to form a loop. A first terminal of the resistor is connected to the loop, and a second terminal of the resistor is connected to the ground. A voltage detection contact point is located on the loop where at least one secondary coil of the balance transformers is interposed from a point to which the first terminal of the resistor is connected.

In further exemplary embodiments of the present invention, an LCD includes a liquid crystal panel displaying an image. The liquid crystal panel may include a plurality of gate lines, a plurality of data lines perpendicular to the gate lines, a plurality of switching elements connected to the gate lines and the data lines, and liquid crystal elements connected to the switching elements and an inverter circuit. The LCD may also include a display unit having the liquid crystal panel, a data circuit and a gate circuit connected to the liquid crystal panel, a backlight assembly having a plurality of discharge tubes, a case receiving the backlight assembly, a top chassis protecting the liquid crystal panel, and at least one optical sheet disposed between the liquid crystal panel and the backlight assembly. The inverter circuit includes an inverter transformer supplying an AC high voltage to the plurality of discharge tubes. The inverter transformers are disposed such that AC high voltages of secondary coils of the inverter transformers have opposite polarities to one another, a plurality of balance transformers, and a resistor. The discharge tubes include a first discharge tube and a second discharge tube. The first discharge tube, primary coils of the balance transformers, and second discharge tube are connected in series to the AC high voltages of the opposite polarities outputted from the secondary coils of the inverter transformers. Secondary coils of the balance transformers are connected in series to form a loop. A first terminal of a resistor is connected to the loop, and a second terminal of the resistor is connected to the ground. A voltage detection contact point is located on the loop where at least one secondary coil of the balance transformers is interposed between the voltage detection contact point and a point to which the first terminal of the resistor is connected.

In other exemplary embodiments of the present invention, a method of detecting an abnormal discharge within a backlight assembly including a plurality of discharge tubes includes supplying an AC high voltage to first terminals of the plurality of discharge tubes, detecting a voltage of a voltage detection contact point located in a loop of series-connected secondary coils of a plurality of balance transformers, primary coils of the balance transformers connected to second terminals of the plurality of discharge tubes, comparing the voltage of the voltage detection contact point to at least one reference voltage, and generating at least one control voltage of a low level or a high level when the voltage of the voltage detection contact point is higher than the at least one reference voltage.

BRIEF DESCRIPTION OF THE DRAWINGS

The above and other advantages of the present invention will become readily apparent by reference to the following detailed description when considered in conjunction with the accompanying drawings wherein.

DETAILED DESCRIPTION OF THE INVENTION

Figure 1:
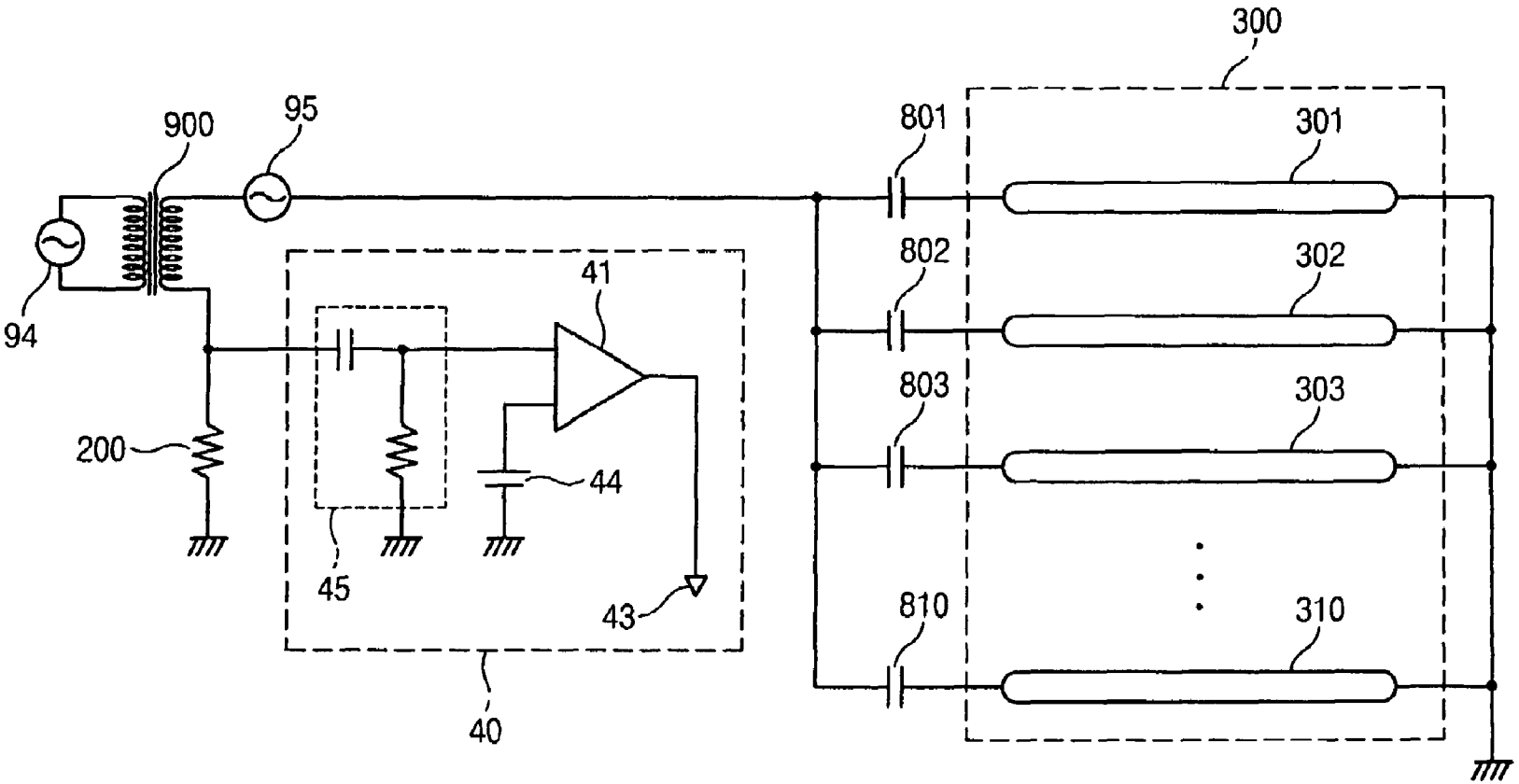
Fig. 1 (PRIOR ART)
FIG. 1 is a circuit diagram of a conventional detector detecting a high-voltage abnormal discharge.
Figure 2:
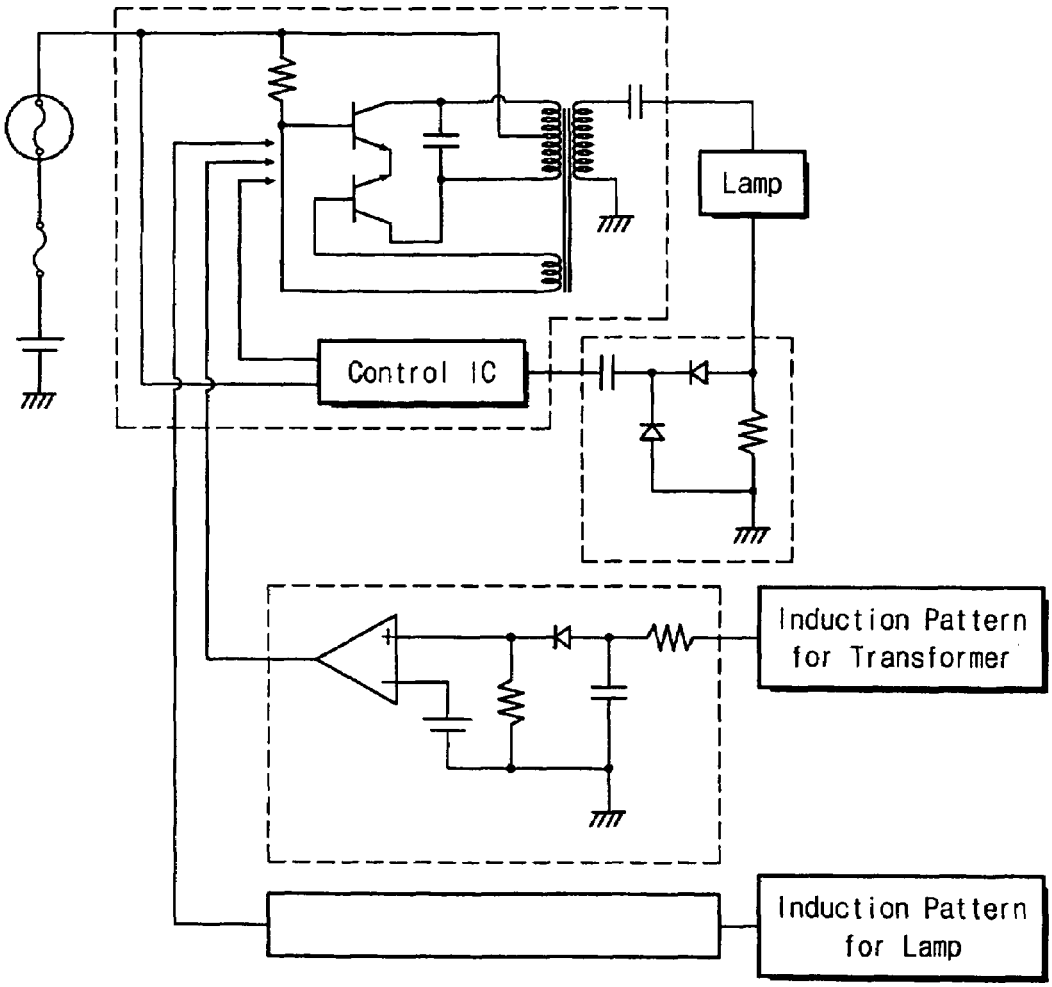
Fig. 2 (PRIOR ART)
FIG. 2 is a circuit diagram of another conventional detector detecting a high-voltage abnormal discharge.

Reference will now be made in detail to the preferred embodiments of the present invention, examples of which are illustrated in the accompanying drawings. However, the present invention is not limited to the embodiments illustrated hereinafter, and the embodiments herein are rather introduced to provide easy and complete understanding of the scope and spirit of the present invention. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Hereinafter, the present invention will be described in detail with reference to the accompanying drawings.

Figure 3:
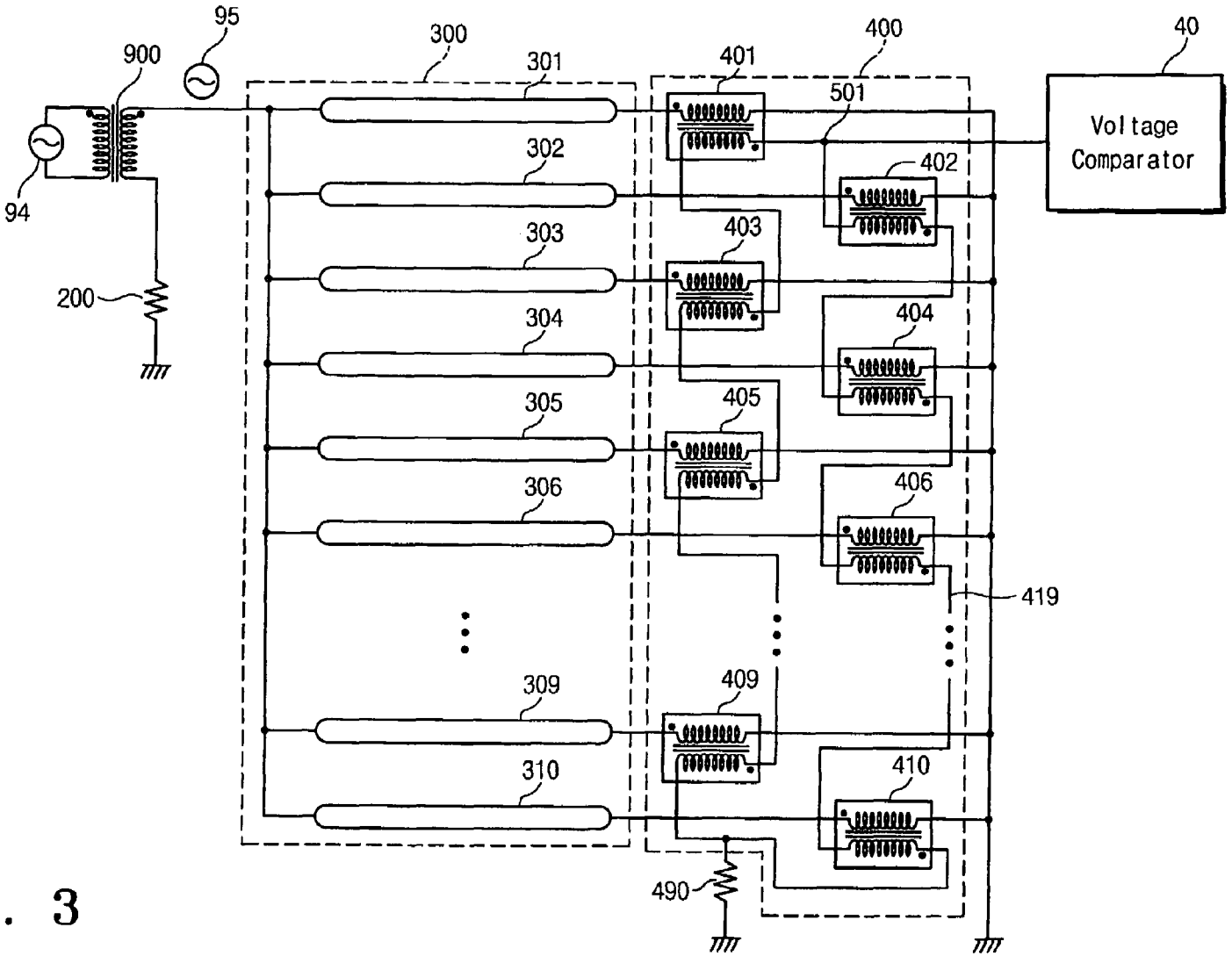
FIG. 3 is a circuit diagram of an exemplary detector detecting a high-voltage abnormal discharge using an exemplary balance transformer according to an exemplary embodiment of the present invention.

FIG. 3 is a circuit diagram of an exemplary inverter circuit that detects a high-voltage abnormal discharge, such as a coronal discharge and an arc discharge, and an exemplary backlight assembly.

Referring to FIG. 3, in the inverter circuit and the backlight assembly, an AC voltage 94 is generated by an oscillation circuit with switching transistors and so on, and an inverter transformer 900 boosts the AC voltage to AC high voltage 95 necessary to turn on discharge tubes, such as cold cathode fluorescent lamps ("CCFLs") 300, including a number of CCFLs, for example, CCFLs 301 to 310. Although the discharge tubes are described herein as CCFLs, the present invention is not limited to the CCFLs, but can also be applied to other systems that turn on a plurality of discharge tubes requiring an AC high voltage. Thus, the discharge tubes should not be construed as being limited to the CCFLs. A current detection resistor 200 may be connected to a ground side of a secondary coil of the inverter transformer 900. A first terminal of each CCFL 301 to 310 is connected in parallel to the secondary coil of the inverter transformer 900, and a second terminal of each CCFL 301 to 310 is connected to a primary coil of the balance transformers 401 to 410, respectively, shown collectively as balance transformers 400. While ten CCFLs 301 to 310 and ten balance transformers 401 to 410 are shown and described, it should be understood that alternative numbers of CCFLs and balance transformers would be within the scope of these embodiments.

A resistor 490 is inserted between a point of a loop, which is formed by the secondary coils of the balance transformers 400, and a ground. All of the secondary coils in the balance transformers 401 to 410 are connected together to form the loop. A voltage detection contact point 501 is disposed on the loop where at least one secondary coil of the balance transformers 400 is interposed from a point to which one terminal of the resistor 490 is connected. A voltage comparator 40 compares a voltage detected at the voltage detection contact point 501 with a predefined reference voltage.

Figure 12:
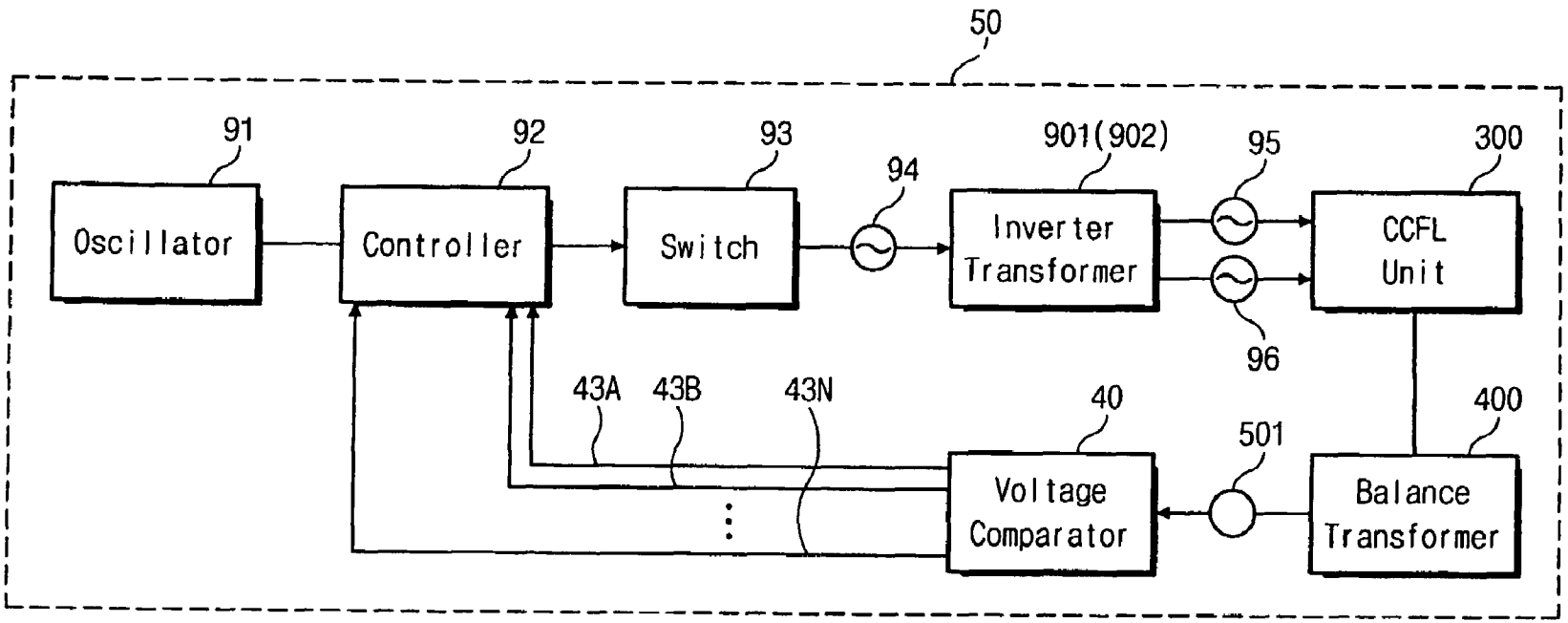
FIG. 12 is a block diagram of an exemplary inverter and an exemplary backlight in the exemplary LCD of FIG. 11.

The AC voltage 94 may be generated by turning on/off switching transistors at a predetermined timing according to a pulse width modulation ("PWM") control signal. In FIG. 12, for example, the AC voltage 94 is generated from a switch 93.

The inverter transformer 900 is a booster transformer that boosts the AC voltage 94 (V1) applied to the primary coil of the inverter transformer 900 to the AC high voltage 95 (V2) for driving the CCFLs 300. In the present embodiment, N2=N1×(V2/N1), where N2 represents the number of turns in the secondary coil and N1 represents the number of turns in the primary coil of the inverter transformer 900.

Each of the CCFLs 300 has a first terminal connected to the output terminal of the secondary coil of the inverter transformer 900 and a second terminal grounded through the primary coils of the balance transformers 400, as will be further described below.

The respective balance transformers 400 are arranged such that the primary coil and the secondary coil of each of the balance transformers 401 to 410 have opposite polarities to each other. Upon the operation of the balance transformers 400, when a current flows through each CCFL 301 to 310, a current flows through the primary coil of each balance transformer 401 to 410 connected in series between each CCFL 301 to 310 and the ground, and thus a current flows through the secondary coil of each balance transformer 401 to 410. At this point, the relationship between the primary and secondary sides of the balance transformers 400 is given by $$IL=IS\times N1/N2$$

where N1 and N2 represent the number of turns in each primary coil and each secondary coil, respectively, and IL and IS represent the current flowing through each primary coil and each secondary coil, respectively.

Since the secondary coils of the balance transformers 400 form a loop in series connection with each other, a current flowing through the loop of the secondary coils makes a current flow through the primary coils of each balance transformer 401 to 410. Consequently, the current flowing through each CCFL 301 to 310 is controlled toward a constant direction. In this manner, an insertion of the balance transformers 400 makes the current flow through each CCFL 301 to 310 uniformly, and the brightness scattering caused by the CCFLs 300 can be prevented.

The resistor 490 is disposed between a point of the secondary coil loop of the balance transformers 400 and the ground. The resistor 490 is used to convert the current flowing through the secondary coil loop into a voltage.

A high-voltage abnormal discharge has various modes. The current flowing through the secondary coil loop of the balance transformers 400 is different according to the modes of the high-voltage abnormal discharge. Due to the insertion of the resistor 490, a dynamic range of a voltage detected at the voltage detection contact point 501 is widened. The wide dynamic range makes it possible to detect the voltages according to the various modes of the high-voltage abnormal discharge.

The most preferable voltage detection contact point 501 is a point of the loop where half of the secondary coils are interposed from the point where the resistor 490 is connected on the loop of the secondary coils of the balance transformers 400. For example, where ten balance transformers 401 to 410 are provided, five of the secondary coils within the loop are positioned between the voltage detection contact point 501 and the point of the loop to which the resistor 490 is connected.

The voltage modes detected at the voltage detection contact point 501 will be described below with respect to FIGS. 4 to 6, following descriptions of alternate embodiments of the present invention.

Figure 7:
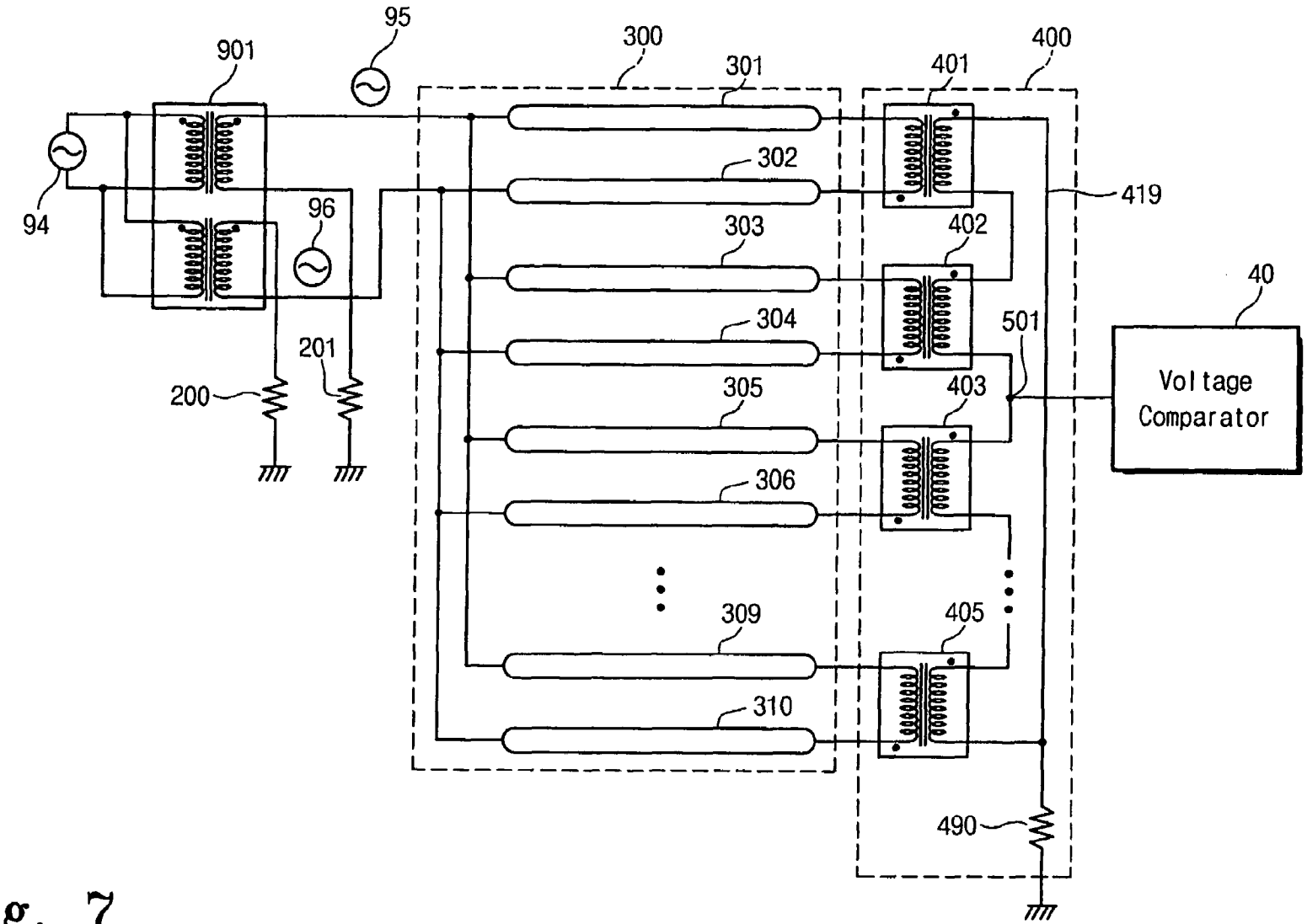
FIG. 7 is a circuit diagram of an exemplary detector detecting a high-voltage abnormal discharge using an exemplary balance transformer according to another exemplary embodiment of the present invention.

Another exemplary embodiment of the present invention will be described with reference to FIG. 7. FIG. 7 is a circuit diagram of an exemplary inverter circuit and an exemplary backlight assembly detecting a high-voltage abnormal discharge according to another exemplary embodiment of the present invention.

Unlike the exemplary embodiment of FIG. 3, an inverter transformer 901 includes two primary coils and two secondary coils, the two secondary coils being disposed to have AC high voltages 95 and 96 of opposite polarities. In other words, the secondary coils of an inverter transformer 901 are arranged to output AC high voltages 95 and 96 having a phase difference of 180°. One of the secondary coils may be connected to a current detection resistor 200, and the other of the secondary coils may be connected to a current detection resistor 201, both of which are connected to a ground side of the secondary coils. A first CCFL 301 and a primary coil of a balance transformer 401 are interposed between the AC high voltages 95 and 96 of opposite phases and are connected in series to a second CCFL 302. In other words, a first CCFL 301 is connected to AC high voltage 95 and a first end of a primary coil of balance transformer 401 and a second CCFL 302 is connected to AC high voltage 96 and a second end of the primary coil of balance transformer 401. Also, a plurality of the series connections of CCFL-primary coil of the balance transformer-CCFL between the AC high voltages 95 and 96 is arranged in parallel. Thus, only half the number of balance transformers 400 may be required as compared to the embodiment of FIG. 3.

The embodiment of FIG. 7 teaches a method of driving the CCFLs 300 using a differential voltage. Because the CCFLs 300 are driven at a high voltage, electrostatic noise radiated from the CCFLs 300 is great. The electrostatic noise has a great influence on the LCD to which the CCFLs 300 provide light. Therefore, it is preferable to offset the electrostatic noise by driving adjacent CCFLs 300 by the voltages 95, 96 whose phases are alternately changed by 180°. According to the method of FIG. 7, because the adjacent CCFLs 300 are driven by the voltages 95, 96 having the phase difference of 180°, the electrostatic noises radiated from the CCFLs 300 and influences on the LCD to which the CCFLs 300 provide light may be reduced.

The method of FIG. 7 detecting the high-voltage abnormal discharge, such as the corona discharge, the arc discharge, etc., which is caused when the insulation failure occurs in the insulating material between the high voltage part and the ground, may be substantially identical to that of FIG. 3. That is, using the balance transformers 400, the resistor 490 and the voltage comparator 40, the voltage detected at the voltage detection contact point 501 is compared with the predefined reference voltage. When the detected voltage is higher than the reference voltage, the voltage comparator 40 outputs a control voltage to detect the occurrence of high-voltage discharge such as corona discharge and arc discharge.

Figure 8:
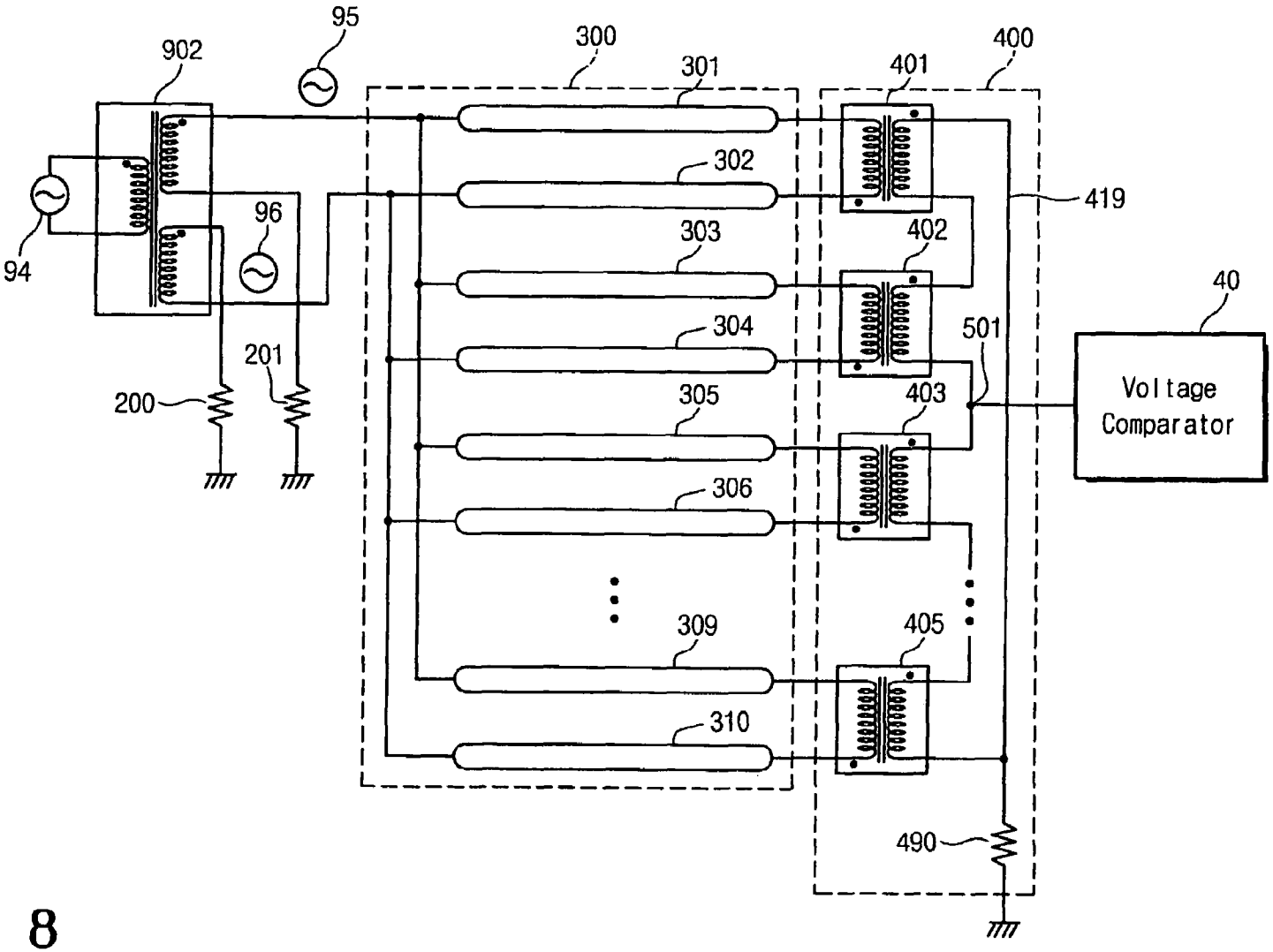
FIG. 8 is a circuit diagram of an exemplary detector detecting a high-voltage abnormal discharge using an exemplary balance transformer according to another exemplary embodiment of the present invention.

FIG. 8 is a circuit diagram of an exemplary inverter circuit and an exemplary backlight assembly detecting a high-voltage abnormal discharge according to another exemplary embodiment of the present invention.

The inverter circuit and backlight assembly of FIG. 8 are substantially the same as that of FIG. 7, except for an inverter transformer 902 having a single primary coil and two secondary coils. The inverter transformer 902 can obtain almost the same effects as those of the inverter circuit of FIG. 7, and a description of like elements will be omitted.

Figure 9A:
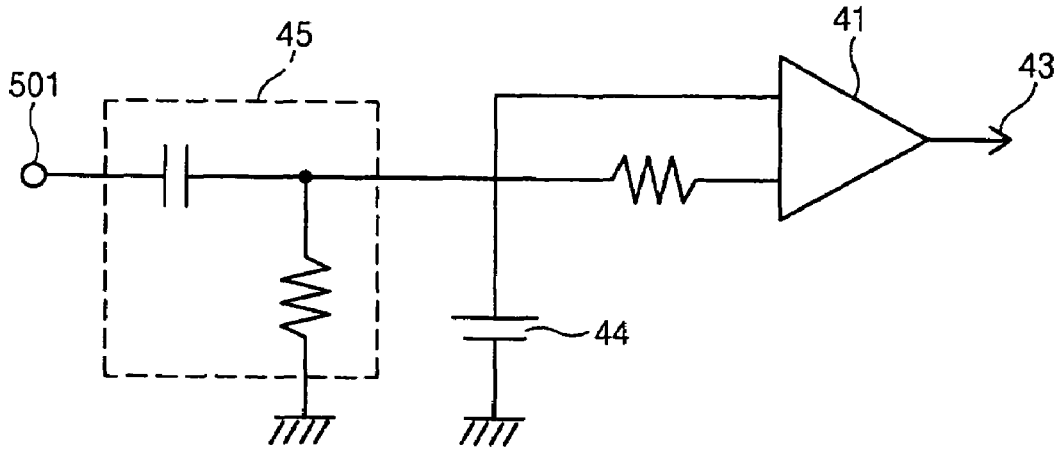
FIGS. 9A and 9B are circuit diagrams of exemplary voltage comparators according to exemplary embodiments of the present invention.
Figure 9B:
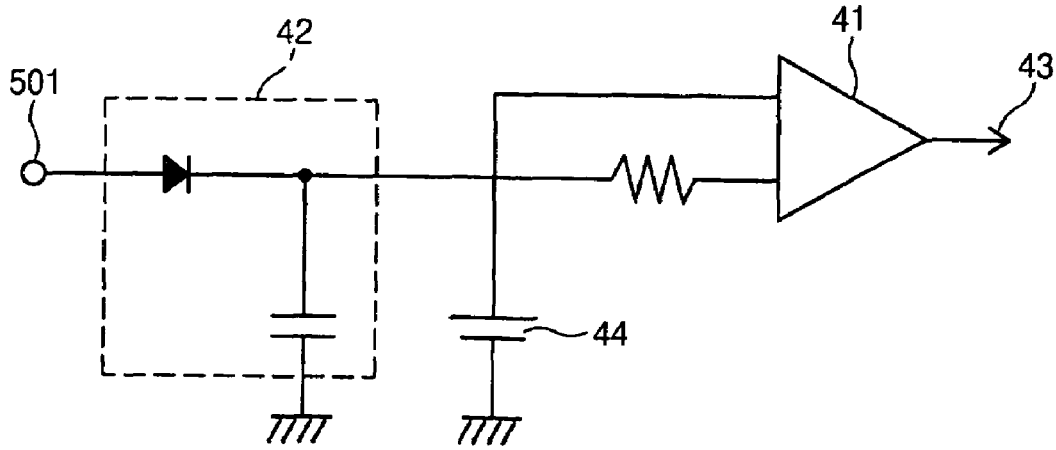

Hereinafter, the inverter circuit and the backlight assembly using the voltage detected at the voltage detection contact point 501 will be further described. FIGS. 9A and 9B are circuit diagrams illustrating the operation of comparing the voltage detected at the voltage detection contact point 501 with a reference voltage 44. The voltage detected at the voltage detection contact point 501 maintains a somewhat constant level in a normal state, but exhibits a higher level in an abnormal state, for example, when a high-voltage abnormal discharge, such as a corona discharge, an arc discharge, etc., occurs between lines. Using this characteristic, it is possible to configure a system that can immediately avoid the high-voltage abnormal discharge by the inverter control.

Referring to FIG. 9A, a differential circuit 45 implemented with a condenser and a resistor detects a peak voltage at the voltage detection contact point 501, and a comparator 41 compares the detected peak voltage with a reference voltage 44 and outputs a control voltage 43.

Referring to FIG. 9B, because a voltage detected at the voltage detection contact point 501 is an AC voltage, a rectifier 42 converts the detected voltage into a DC voltage, and a comparator 41 compares the DC voltage with a reference voltage 44 and outputs a control voltage 43. In the voltage comparators 40 of FIGS. 9A and 9B, when the detected voltage exceeds the reference voltage 44, the control voltage 43 may be a low level voltage or a high level voltage according to the configuration of the voltage comparator 40. Also, methods of comparing the detected voltage with the reference voltage 44 are not limited to the embodiments of FIGS. 9A and 9B.

The voltage comparator 40 may use a method of sampling a peak voltage or a method of rectifying the AC voltage into the DC voltage and comparing the DC voltage with the reference voltage 44. Therefore, the voltage comparator 40 can also be applied to the embodiments of FIGS. 7 and 8.

Figure 10:
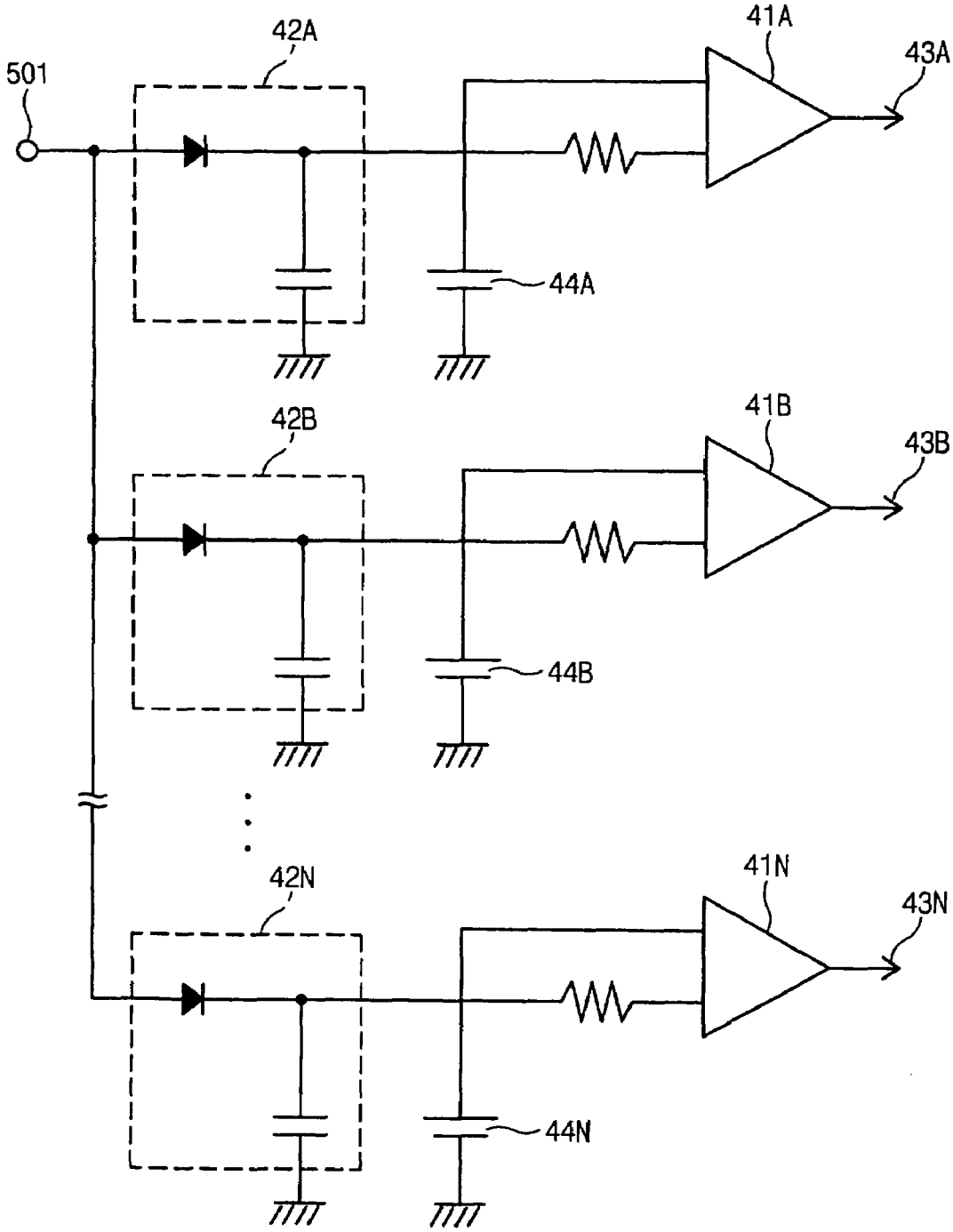
FIG. 10 is a circuit diagram of a plurality of exemplary voltage comparators.

FIG. 10 is a circuit diagram of a plurality of voltage comparators. Each of the voltage comparators has a same structure as that of FIG. 9B, such as including rectifiers 42A, 42B, . . . , 42N and comparators 41A, 41B, . . . , 41N. Reference voltages 44A, 44B, . . . , 44N of the respective voltage comparators are set to different levels. If the voltage comparators are provided and their reference voltages 44A, 44B, . . . , 44N are set to different levels, the driving method of the inverter circuit can be changed to cope with the current concentration on a specific CCFL, an open circuit or short circuit caused by breakdown of the CCFL, and other high-voltage abnormal discharge modes. That is, the voltage modes detected at the voltage detection contact point 501 exhibit different values, coping with other overcurrent modes or high-voltage abnormal discharge mode. A controller can change the driving method of the inverter circuit by selectively determining the voltage modes detected at the voltage detection contact point 501 and the control voltages 43A, 43B, . . . , 43N outputted from the voltage comparators. For example, the driving method of the inverter circuit can be changed according to the overcurrent mode or the high-voltage abnormal discharge mode, which is caused by the change of PWM control.

The voltage modes detected at the voltage detection contact point 501 will now be described below with reference to FIGS. 4-6.

Figure 4:
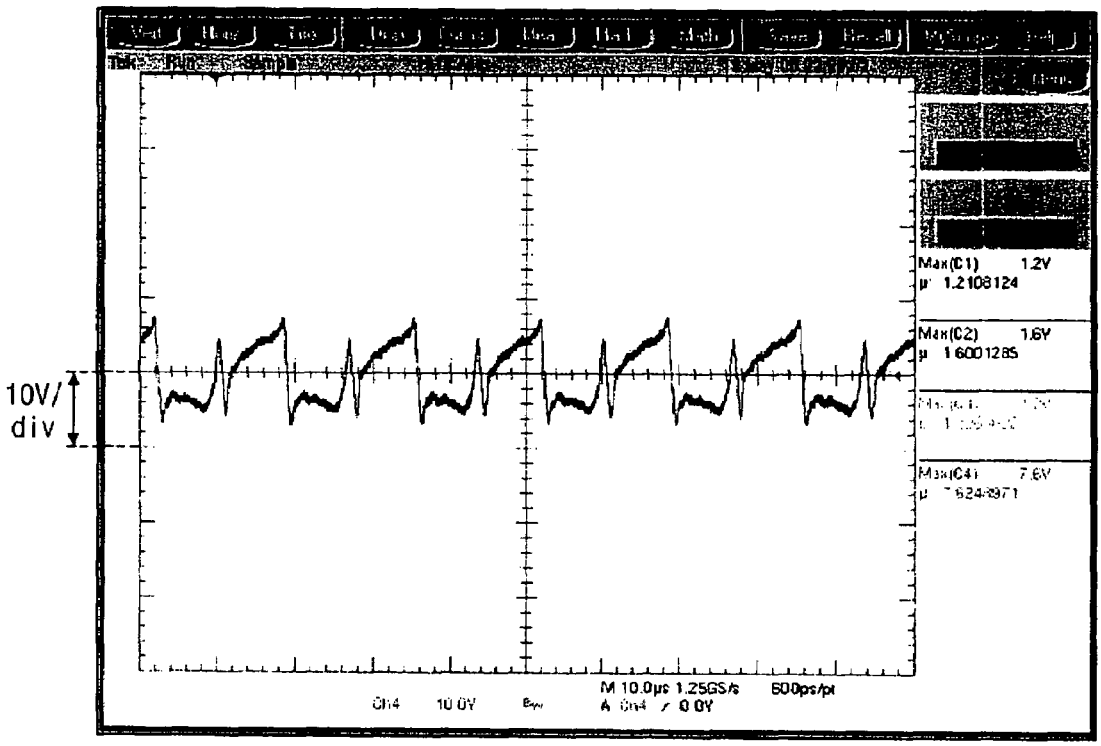
FIG. 4 is a waveform diagram of a voltage detected at a voltage detection contact point in the exemplary detector of FIG. 3.

FIG. 4 is a waveform diagram of the voltage detected at the voltage detection contact point 501 when the CCFLs connected in parallel are normally turned on and normally operated in a state in which the high-voltage abnormal discharge such as the corona discharge or the arc discharge does not occur between the high voltage part and the ground. A peak voltage is about 7.6 V.

Figure 5:
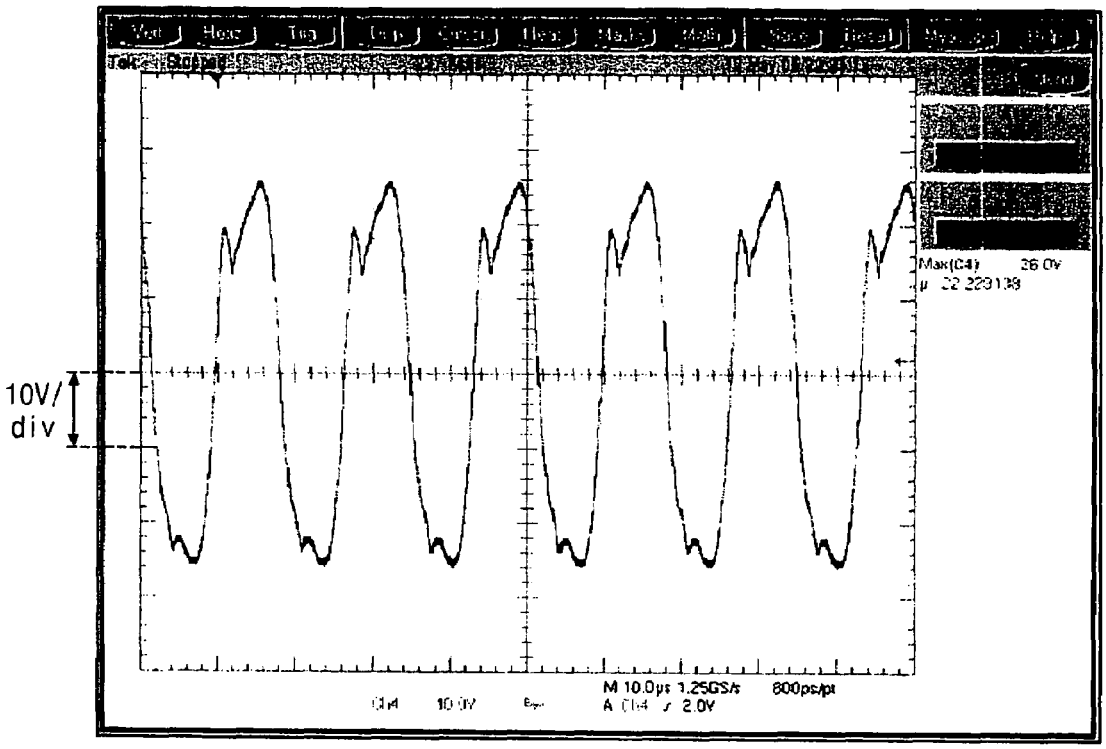
FIG. 5 is a waveform diagram of a voltage detected at a voltage detection contact point when a 100-KΩ-impedance element is inserted between a high voltage part and a ground in the exemplary detector of FIG. 3.

FIG. 5 is a waveform diagram of the voltage detected at the voltage detection contact point 501 when a 100-KΩ impedance element is inserted between the high voltage part and the ground in the CCFL. A peak voltage is about 26 V.

Figure 6:
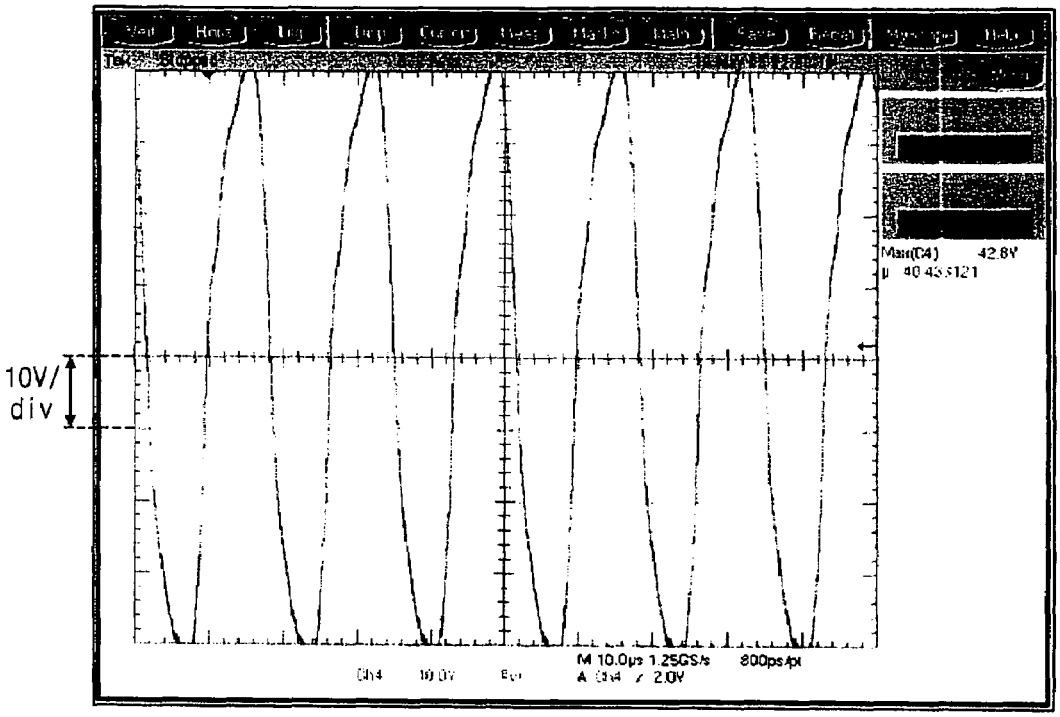
FIG. 6 is a waveform diagram of a voltage detected at a voltage detection contact point when a high voltage part and the ground are shorted in the exemplary detector of FIG. 3.

FIG. 6 is a waveform diagram of the voltage detected at the voltage detection contact point 501 when the high voltage part and the ground are shorted in the CCFL. A peak voltage is about 42.8 V.

The voltage modes detected at the voltage detection contact point 501 exhibit different modes when the CCFL normally operates, when the CCFL is shorted with the high voltage part, and when a predetermined impedance is connected between the high voltage part and the ground, respectively. The detected voltages are supplied to the voltage comparator 40 for comparison with a reference voltage or voltages for outputting a control signal that may be received by a controller for appropriate action.

Figure 11:
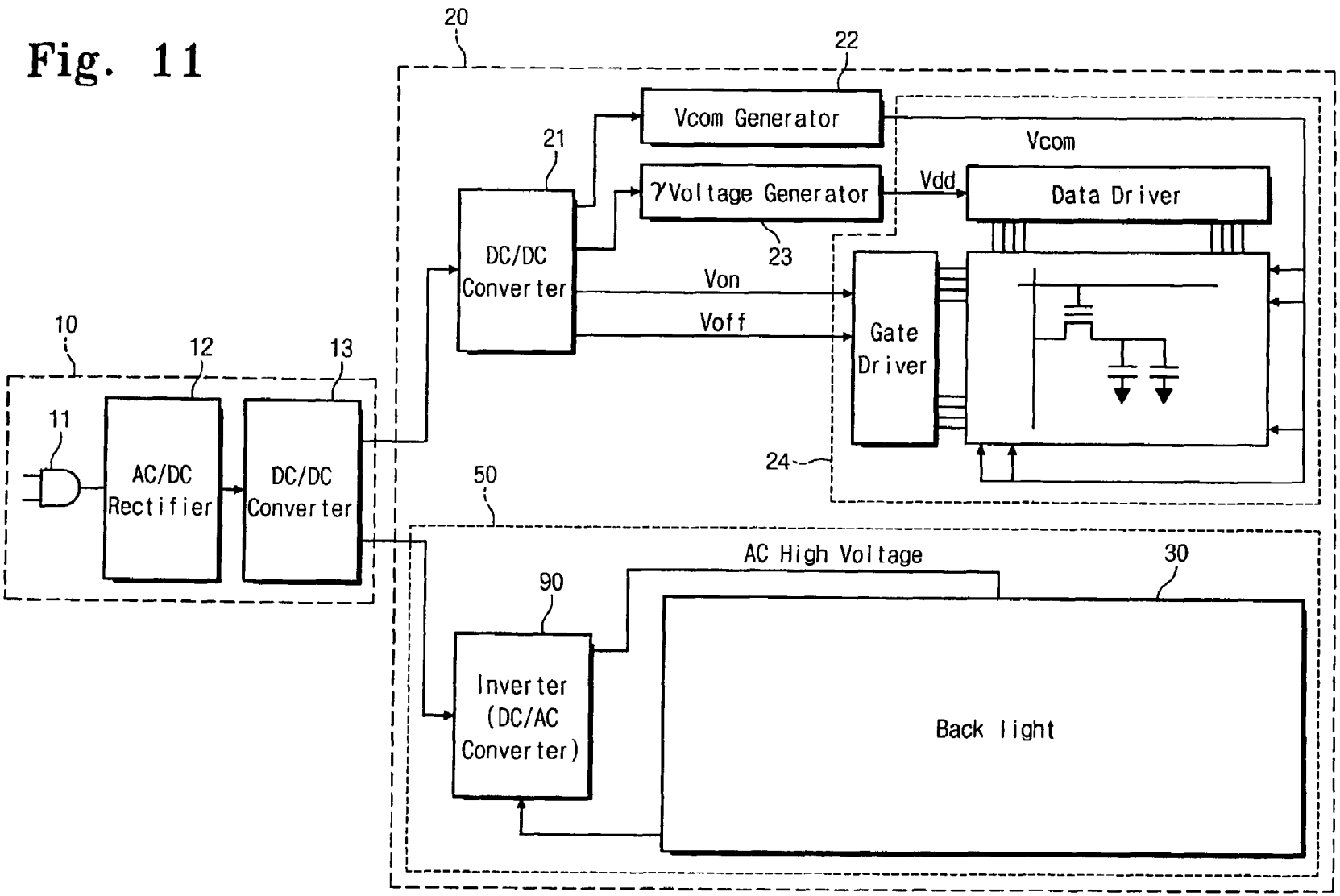
FIG. 11 is a block diagram of an exemplary LCD according to an exemplary embodiment of the present invention.

FIG. 11 is a block diagram of a lamp driver of an exemplary LCD having an exemplary inverter circuit and an exemplary backlight assembly according to an exemplary embodiment of the present invention.

Referring to FIG. 11, the LCD includes an AC/DC power supply 10, an LCD module 20, and a backlight assembly 50 including an inverter 90 and a backlight 30.

The AC/DC power supply 10 includes an outlet 11, an AC/DC rectifier 12, and a DC/DC converter 13. The AC/DC power supply 10 converts an external AC of, for example, about 100 volts to about 240 volts into a DC voltage and outputs the converted DC voltage to the LCD module 20.

The LCD module 20 includes a DC/DC converter 21, a common electrode voltage (Vcom) generator 22, a gamma (γ) voltage generator 23, an LCD panel 24, an inverter 90, and a backlight assembly 30. The LCD module 20 receives the DC voltage from the AC/DC power supply 10 and displays an image supplied from an external graphic controller (not shown) on the LCD panel 24.

The Vcom generator 22 generates a common electrode voltage Vcom based on the DC voltage whose level is shifted by the DC/DC converter 21, and supplies the common electrode voltage Vcom to the LCD panel 24.

The gamma (γ) voltage generator 23 generates a gamma (γ) voltage Vdd based on the level-shifted DC voltage and supplies the gamma (γ) voltage to the LCD panel 24. Although the Vcom generator 22 and the gamma (γ) voltage generator 23 are separated from the LCD panel 24 in FIG. 11, they can also be included in the LCD panel 24.

As described above, the LCD includes the AC/DC power supply 10 and the LCD module 20 that is separated from the AC/DC power supply 10. In the inverter circuits and the backlight assemblies of FIGS. 3, 7 and 8, when the abnormal state such as the high-voltage abnormal discharge occurs, the voltage comparator 40, which may be included in the backlight assembly 50, compares the voltage detected at the voltage detection contact point 501 with the reference voltage to generate the control voltage 43 (low level or high level). For example, the inverter circuit 90 is controlled by the method (not shown) of controlling duty ratio of PWM oscillation, and the AC voltage supplied to the backlight 30 is adjusted, thereby preventing the reduction of lifetime of the CCFLs.

FIG. 12 is a block diagram of an exemplary backlight assembly 50 including an inverter circuit 90 and a backlight 30 in an exemplary LCD according to an exemplary embodiment of the present invention.

Referring to FIG. 12, the inverter circuit 90 and the backlight 30, including the CCFL unit 300, include an oscillator 91, a controller 92 connected to the oscillator 91, a switch 93 connected to the controller 92, an inverter transformer 901 connected between the switch 93 and the backlight 30, a balance transformer 400 connected between the backlight 30 and the controller 92, and a voltage comparator 40.

When a high-voltage abnormal discharge such as a corona discharge, an arc discharge, etc., occurs due to an insulation failure caused by in an insulating material between the high voltage part and the ground, the voltage comparators 40A to 40N receive the voltage detected at the voltage detection contact point 501 to generate the control voltages 43A to 43N of a low level or a high level. For example, when the PWM oscillation is used, the driving frequency and the driving voltage of the backlight 30 are adjusted by the control of a pulse duty, or the supply of the driving voltage is interrupted. When the insulation failure occurs in the insulating material between the high voltage part and the ground, the abnormal state can be avoided by immediately performing the control operation according to the abnormal state mode of the high-voltage abnormal discharge.

In addition, the present invention can improve the performance of the LCD by applying the inverter circuit and the backlight assembly of the present invention.

Figure 13:
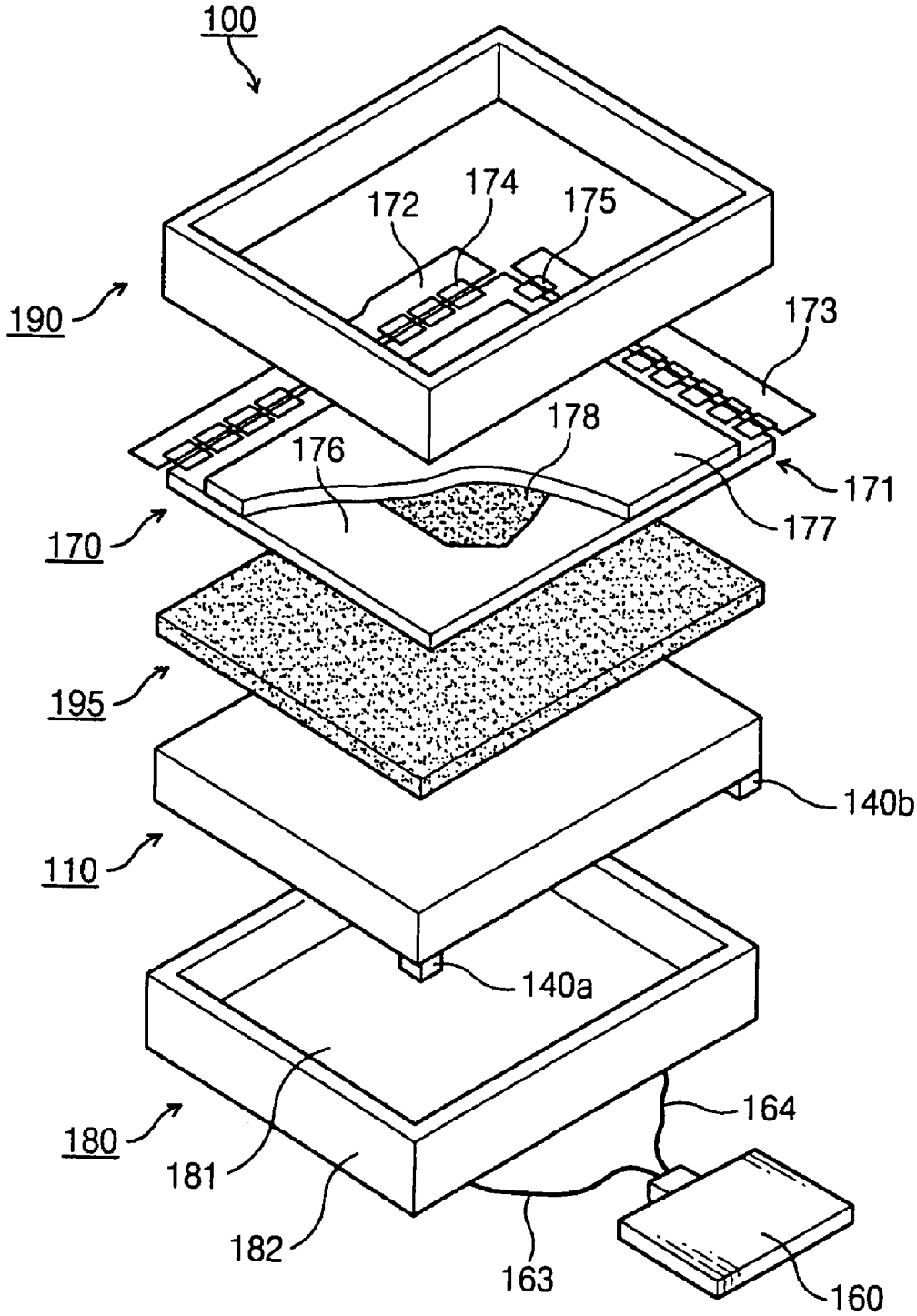
FIG. 13 is an exploded perspective view of the exemplary LCD of FIG. 11.

FIG. 13 is an exploded perspective view of an exemplary LCD according to an exemplary embodiment of the present invention.

Referring to FIG. 13, the LCD 100 includes a backlight assembly 110, a display unit 170, and a case 180.

The display unit 170 includes a liquid crystal panel 171 displaying an image, a data printed circuit 172 and a gate printed circuit 173 generating a driving signal to drive the liquid crystal panel 171. The data printed circuit 172 and the gate printed circuit 173 are electrically connected to the liquid crystal panel 171 through a data tape carrier package ("TCP") 174 and a gate TCP 175, respectively.

The liquid crystal panel 171 includes a thin film transistor ("TFT") substrate 176, a color filter substrate 177 facing the TFT substrate 176, and a liquid crystal layer 178 interposed between the TFT substrate 176 and the color filter substrate 177.

The TFT substrate 176 is a glass substrate in which switching TFTs (not shown) are arranged in a matrix. Source terminals and gate terminals of the TFTs are connected to the data lines and the gate lines, respectively. Also, pixel electrodes (not shown) formed of a transparent conductive material are connected to drain terminals.

For example, the color filter substrate 177 includes RGB pixels (not shown) that are formed using a thin film process. The color filter substrate 177 includes a common electrode (not shown) formed of a transparent conductive material.

The case 180 has a bottom plate 181 and sidewalls 182 extending from edges of the bottom plate 181 to provide a receiving space. The case 180 receives the backlight assembly 110 and the liquid crystal panel 171.

The bottom plate 181 is sufficiently wide for receiving the backlight assembly 110 therein. It is preferable that the bottom plate 181 has substantially the same peripheral shape as the backlight assembly 110. In this embodiment, the bottom plate 181 and the backlight assembly 110 both have a rectangular plate-like shape. The sidewalls 182 are extended from the edges of the bottom plate 181 in a substantially vertical direction, so that the backlight assembly 110 cannot be displaced from the case 180.

In this embodiment, the LCD 100 further includes an inverter circuit 160 and a top chassis 190.

The inverter circuit 160 is disposed outside the case 180 to generate a discharge voltage that drives the backlight assembly 110. The discharge voltage generated from the inverter circuit 160 is applied to the backlight assembly 110 through a first voltage line 163 and a second voltage line 164. The first voltage line 163 and the second voltage line 164 are electrically connected to a first electrode 140*a* and a second electrode 140*b* formed on both sides of the backlight assembly 110. The first voltage line 163 and the second voltage line 164 may be directly connected to the first electrode 140*a* and the second electrode line 140*b*, respectively. Also, the first voltage line 163 and the second voltage line 164 may be connected to the first electrode 140*a* and the second electrode line 140*b* through a connecting member (not shown). Moreover, the balance transformers 400 as previously described above may be built in the inverter circuit 160 or the backlight assembly 110.

The top chassis 190 is coupled to the case 180 while surrounding the edges of the liquid crystal panel 171. The top chassis 190 can prevent the liquid crystal panel 171 from being damaged due to external impacts. Also, the top chassis 190 can prevent the liquid crystal panel from being released from the case 180.

The liquid crystal panel 100 may further include at least one optical sheet 195 so as to improve characteristics of light emitted from the backlight assembly 110. The optical sheet 195 may include a diffusion sheet to diffuse the light and a prism sheet to condense the light.

According to the inverter circuit, the backlight assembly, and the LCD of the present invention, it is possible to detect the abnormal state caused by the high-voltage discharge such as corona discharge or arc discharge. Also, it is possible to detect the open circuit or short circuit caused by current concentration and breakdown of the CCFLs.

Since the resistor is interposed in the loop of the secondary coils of the balance transformers and connected to the ground, the voltage detected at the voltage detection contact point has a wide dynamic range and thus other detection voltage can be determined by various abnormal state modes. Also, since two CCFLs may be alternately driven using voltages of 180° phase difference, electrostatic noise radiated from the CCFLs can be offset and its influence on liquid crystal can be reduced.

In addition, after detecting the high-voltage abnormal discharge caused when the insulation failure occurs in the insulating material between the high voltage part and the ground, the comparator compares the detected voltage with the reference voltage. When the detected voltage exceeds the reference voltage, the comparator outputs the control signal (high level voltage or low level voltage). Therefore, the abnormal discharge state can be transferred to the controller.

Moreover, when the voltage comparators having different reference voltages are provided, they may or may not output the control signal according to the magnitude of the detected voltages informing the occurrence of the high-voltage abnormal discharge. The controller receiving the control signal can control the abnormal state mode by identifying the voltage comparator that outputs the control signal.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An inverter circuit comprising:

an inverter transformer supplying an AC high voltage to a plurality of discharge tubes, one output terminal of the inverter transformer connected to first terminals of the discharge tubes;

a plurality of balance transformers, wherein the balance transformers are arranged such that a primary coil and a secondary coil of each of the balance transformers have opposite polarities to each other; and a resistor, wherein first terminals of primary coils of the balance transformers are connected to second terminals of the discharge tubes, and second terminals of the primary coils of the balance transformers are connected to a ground;

secondary coils of the balance transformers are connected in series to form a loop;

a first terminal of the resistor is connected to the loop and a second terminal of the resistor is connected to the ground; and a voltage detection contact point is located on the loop where at least one secondary coil of the balance transformers is interposed between the voltage detection contact point and a point to which the first terminal of the resistor is connected.

2. The inverter circuit of claim 1, wherein the voltage detection contact point is a point of the loop where half of the secondary coils of the balance transformers are interposed between the voltage detection contact point and the point to which the first terminal of the resistor is connected.

3. The inverter circuit of claim 1, wherein the inverter transformer has two primary coils and two secondary coils, the two secondary coils being disposed to have AC high voltages of opposite polarities.

4. The inverter circuit of claim 1, wherein the inverter transformer has a single primary coil and two secondary coils, the two secondary coils being disposed to have AC high voltages of opposite polarities.

5. The inverter circuit of claim 1, further comprising a comparator to compare a voltage of the voltage detection contact point with a predetermined reference voltage, the comparator generating a control voltage of a low level or a high level when the voltage of the voltage detection contact point is higher than the reference voltage.

6. The inverter circuit of claim 5, further comprising a plurality of comparators, each receiving a different reference voltage, each of the comparators generating a control voltage of a low level or a high level when the voltage of the voltage detection contact point is higher than the reference voltage received by each respective comparator.

7. The inverter circuit of claim 5, wherein the inverter circuit compares the voltage of the voltage detection contact point with the reference voltage, adjusts a current supplied to the discharge tubes based on a comparison result, and cuts off a voltage supplied to the discharge tubes.

8. An inverter circuit comprising:

an inverter transformer supplying an AC high voltage to a plurality of discharge tubes including a first discharge tube and a second discharge tube, the inverter transformer disposed such that AC high voltages of secondary coils of the inverter transformer have opposite polarities to one another;

a plurality of balance transformers, wherein the balance transformers are arranged such that a primary coil and a secondary coil of each of the balance transformers have opposite polarities to each other; and a resistor, wherein the first discharge tube, primary coils of the balance transformers and the second discharge tube are connected in series to the AC high voltages of the opposite polarities outputted from the secondary coils of the inverter transformer;

secondary coils of the balance transformers are connected in series to form a loop;

a first terminal of the resistor is connected to the loop, and a second terminal of the resistor is connected to a ground; and a voltage detection contact point is located on the loop where at least one secondary coil of the balance transformers is interposed between the voltage detection contact point and a point to which the first terminal of the resistor is connected.

9. The inverter circuit of claim 8, wherein the voltage detection contact point is a point of the loop where half of the secondary coils of the balance transformers are interposed between the voltage detection contact point and the point to which the first terminal of the resistor is connected.

10. The inverter circuit of claim 8, wherein the inverter transformer has two primary coils and two secondary coils, the two secondary coils being disposed to have AC high voltages of opposite polarities.

11. The inverter circuit of claim 8, wherein the inverter transformer has a single primary coil and two secondary coils, the two secondary coils being disposed to have AC high voltages of opposite polarities.

12. The inverter circuit of claim 8, further comprising a comparator to compare a voltage of the voltage detection contact point with a predetermined reference voltage, the comparator generating a control voltage of a low level or a high level when the voltage of the voltage detection contact point is higher than the reference voltage.

13. The inverter circuit of claim 12, further comprising a plurality of comparators, each receiving a different reference voltage, each of the comparators generating a control voltage of a low level or a high level when the voltage of the voltage detection contact point is higher than the reference voltage received by each respective comparator.

14. The inverter circuit of claim 12, wherein the inverter circuit compares the voltage of the voltage detection contact point with the reference voltage, adjusts a current supplied to the discharge tubes based on a comparison result, and cuts off a voltage supplied to the discharge tubes.

15. A backlight assembly comprising:

a plurality of discharge tubes;

an inverter transformer supplying an AC high voltage to the plurality of discharge tubes;

a plurality of balance transformers, wherein the balance transformers are arranged such that a primary coil and a secondary coil of each of the balance transformers have opposite polarities to each other; and a resistor, wherein first terminals of primary coils of the balance transformers are connected to the discharge tubes, and second terminals of the primary coils of the balance transformers are connected to a ground;

first terminals of the discharge tubes are connected to output terminals of the inverter transformer, and second terminals of the discharge tubes are connected to the first terminals of the primary coils of the balance transformers;

secondary coils of the balance transformers are connected in series to form a loop;

a first terminal of the resistor is connected to the loop, and a second terminal of the resistor is connected to the ground; and a voltage detection contact point is located on the loop where at least one secondary coil of the balance transformers is interposed between the voltage detection contact point and a point to which the first terminal of the resistor is connected.

16. A backlight assembly comprising:

a plurality of discharge tubes;

an inverter transformer supplying an AC high voltage to the plurality of discharge tubes, the inverter transformer disposed such that AC high voltages of secondary coils of the inverter transformer have opposite polarities to one another;

a plurality of balance transformers, wherein the balance transformers are arranged such that a primary coil and a secondary coil of each of the balance transformers have opposite polarities to each other; and a resistor, wherein the discharge tubes include a first discharge tube and a second discharge tube;

the first discharge tube, primary coils of the balance transformers and second discharge tube are connected in series to the AC high voltages of the opposite polarities outputted from the secondary coils of the inverter transformer;

secondary coils of the balance transformers are connected in series to form a loop;

a first terminal of the resistor is connected to the loop, and a second terminal of the resistor is connected to a ground; and a voltage detection contact point is located on the loop where at least one secondary coil of the balance transformers is interposed between the voltage detection contact point and a point to which the first terminal of the resistor is connected.

17. A liquid crystal display comprising:

a liquid crystal panel displaying an image; and an inverter circuit including:

an inverter transformer supplying an AC high voltage to a plurality of discharge tubes, at least one output terminal of the inverter transformer connected to first terminals of the discharge tubes;

a plurality of balance transformers, wherein the balance transformers are arranged such that a primary coil and a secondary coil of each of the balance transformers have opposite polarities to each other; and a resistor, wherein first terminals of primary coils of the balance transformers are connected to second terminals of the discharge tubes, and second terminals of the primary coils of the balance transformers are connected to a ground;

secondary coils of the balance transformers are connected in series to form a loop;

a first terminal of the resistor is connected to the loop, and a second terminal of the resistor is connected to the ground; and a voltage detection contact point is located on the loop where at least one secondary coil of the balance transformers is interposed between the voltage detection contact point and a point to which the first terminal of the resistor is connected.

18. The liquid crystal display panel of claim 17, wherein the liquid crystal panel includes a plurality of gate lines, a plurality of data lines substantially perpendicular to the gate lines, a plurality of switching elements connected to the gate lines and the data lines, and liquid crystal elements connected to the switching elements.

19. The liquid crystal display of claim 17, further comprising:

a display unit including the liquid crystal panel, a data circuit and a gate circuit connected to the liquid crystal panel;

a backlight assembly having the plurality of discharge tubes;

a case receiving the backlight assembly;

a top chassis protecting the liquid crystal panel; and at least one optical sheet disposed between the liquid crystal panel and the backlight assembly.

20. A liquid crystal display comprising:

a liquid crystal panel displaying an image; and an inverter circuit including:

an inverter transformer supplying an AC high voltage to a plurality of discharge tubes including a first discharge tube and a second discharge tube, the inverter transformer disposed such that AC high voltages of secondary coils of the inverter transformer have opposite polarities to one another;

a plurality of balance transformers, wherein the balance transformers are arranged such that a primary coil and a secondary coil of each of the balance transformers have opposite polarities to each other; and a resistor, wherein the first discharge tube, primary coils of the balance transformers, and second discharge tube are connected in series to the AC high voltages of the opposite polarities outputted from the secondary coils of the inverter transformer;

secondary coils of the balance transformers are connected in series to form a loop;

a first terminal of the resistor is connected to the loop, and a second terminal of the resistor is connected to a ground; and a voltage detection contact point is located on the loop where at least one secondary coil of the balance transformers is interposed between the voltage detection contact point and a point to which the first terminal of the resistor is connected.

21. The liquid crystal display panel of claim 20, wherein the liquid crystal panel includes a plurality of gate lines, a plurality of data lines substantially perpendicular to the gate lines, a plurality of switching elements connected to the gate lines and the data lines, and liquid crystal elements connected to the switching elements.

22. The liquid crystal display of claim 20, further comprising:

a display unit including the liquid crystal panel, a data circuit and a gate circuit connected to the liquid crystal panel;

a backlight assembly having the plurality of discharge tubes;

a case receiving the backlight assembly;

a top chassis protecting the liquid crystal panel; and at least one optical sheet disposed between the liquid crystal panel and the backlight assembly.

23. A method of detecting an abnormal discharge within a backlight assembly including a plurality of discharge tubes, the method comprising:

supplying an AC high voltage to first terminals of the plurality of discharge tubes;

controlling a current flowing through the discharge tubes by a plurality of balance transformers primary coils connected to second terminals of the discharge tubes and secondary coils forming a loop in series connection with each other, wherein primary coil and secondary coil of each of the balance transformers have opposite polarities to each other;

detecting a voltage of a voltage detection contact point located on the loop and connected with at least one of the secondary coils of the balance transformers;

comparing the voltage of the voltage detection contact point to at least one reference voltage; and generating at least one control voltage of a low level or a high level when the voltage of the voltage detection contact point is higher than the at least one reference voltage.

* * * * *